US006173471B1

(12) United States Patent
Yau

(10) Patent No.: US 6,173,471 B1
(45) Date of Patent: Jan. 16, 2001

(54) STRUCTURE OF A BRUSH

(76) Inventor: Stephen Yau, Unit 702, Lu Plaza 2 Wing Yip St., Kwun Tong, Kowloon (HK)

( * ) Notice: Under 35 U.S.C. 154(b), the term of this patent shall be extended for 0 days.

(21) Appl. No.: 09/450,030

(22) Filed: Nov. 29, 1999

(51) Int. Cl.[7] ..... A46B 7/00

(52) U.S. Cl. ..... 15/244.1; 15/191.1; 15/205; 15/DIG. 4

(58) Field of Search ..... 15/171, 176.4, 15/176.5, 176.6, 191.1, 192, 193, 204, 205, 244.1, DIG. 4

(56) References Cited

U.S. PATENT DOCUMENTS 5,483,723 * 1/1996 Wenzer ..... 15/193

FOREIGN PATENT DOCUMENTS

238011 * 9/1911 (DE) ..... 15/191.1
852199 * 10/1960 (GB) ..... 15/193

* cited by examiner

*Primary Examiner*—Randall E. Chin
(74) *Attorney, Agent, or Firm*—Rosenberg, Klein & Lee

(57) ABSTRACT

A brush structure is provided which allows for even distribution of paint to a surface and further provides for variable stiffness of the bristles. The brush has a handle (10) which engages a ferrule (12) through a dovetail slot (11). The ferrule (12) receives a knob (15) which engages a blade (16) within a bristle member (18). The blade (16) may be variably positioned within the bristle member (18).

1 Claim, 4 Drawing Sheets

STRUCTURE OF A BRUSH

BACKGROUND OF THE INVENTION

1. Field of the Invention

The present invention relates to an improved structure of a brush, more particularly to one with a dovetail engagement in the handle, a ferrule, and an additional adjustment means with a blade sticking into the bristles to control the hardness of the bristles and the size of the application area.

2. Description of the Prior Art

A prior art brush comprises a handle and bristles adhered to each other. Usually, the brush is discarded within two or three applications since the bristles easily detach due to poor adhesion with the handle. The hardness of the bristles is not easily controlled due to the manufacturing process and bristle hardness is not often easily distributed throughout the brush. In practice, many different brushes, in various sizes, must be used to get a job done, thus increasing costs.

SUMMARY OF THE INVENTION

The primary objective of the present invention is to provide a modified structure of a brush having an adjustment means, with a blade sticking into the bristles, the adjustment means being movable within the bristles to control both the area of application and the hardness of the bristles, as desired. Furthermore, the handle and the ferrule are dovetailed, allowing interchangeability between handles and ferrules, depending on the job requirements.

DETAILED DESCRIPTION OF THE INVENTION

Figure 1:
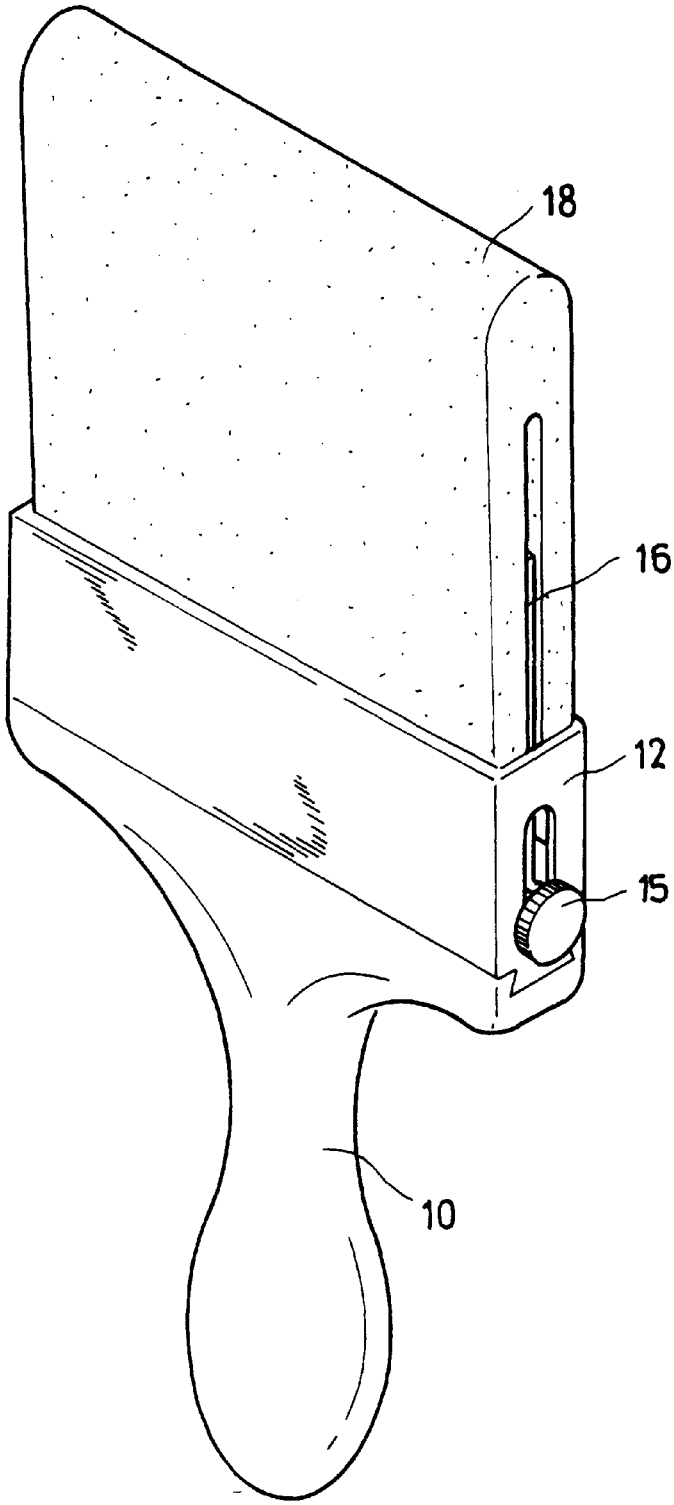
FIG. 1 is an overview of the present invention.
Figure 2:
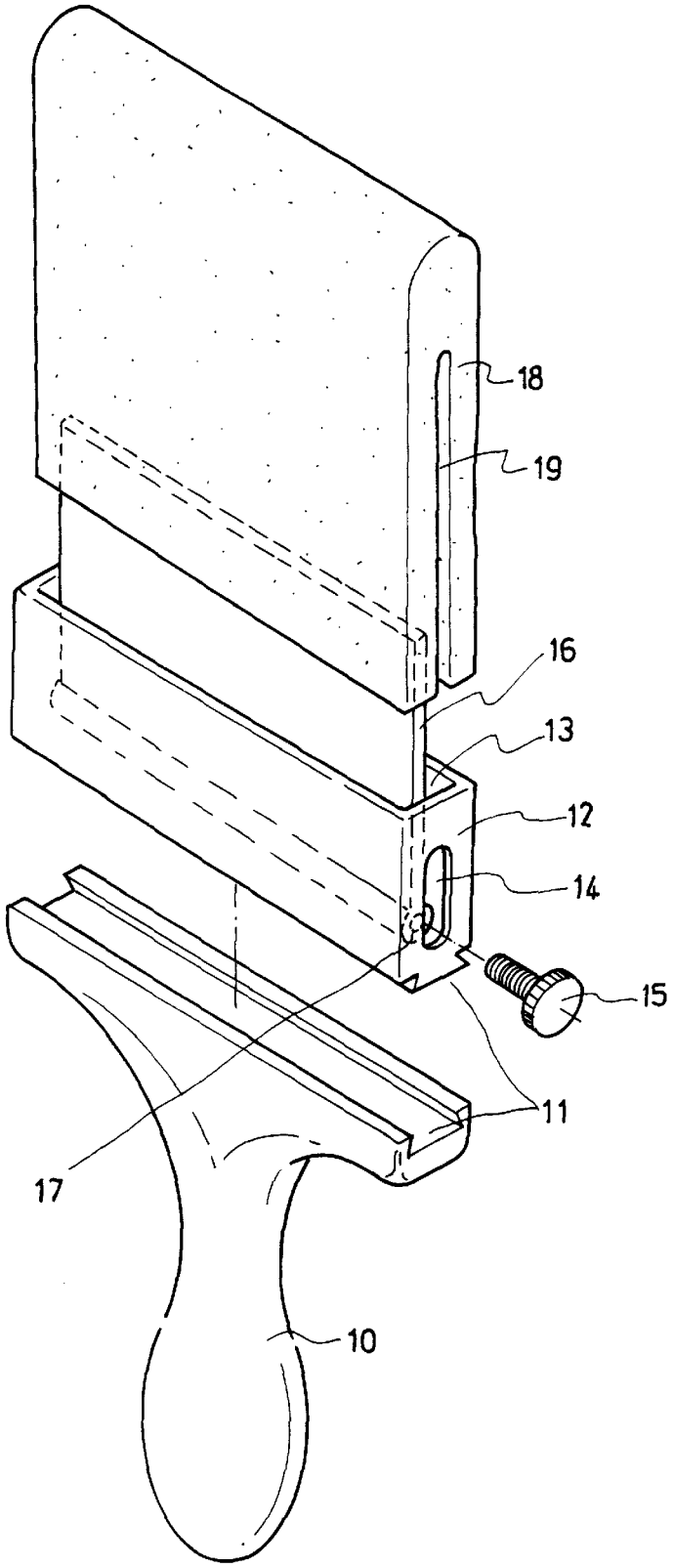
FIG. 2 is a disassembled view of the present invention.
Figure 3:
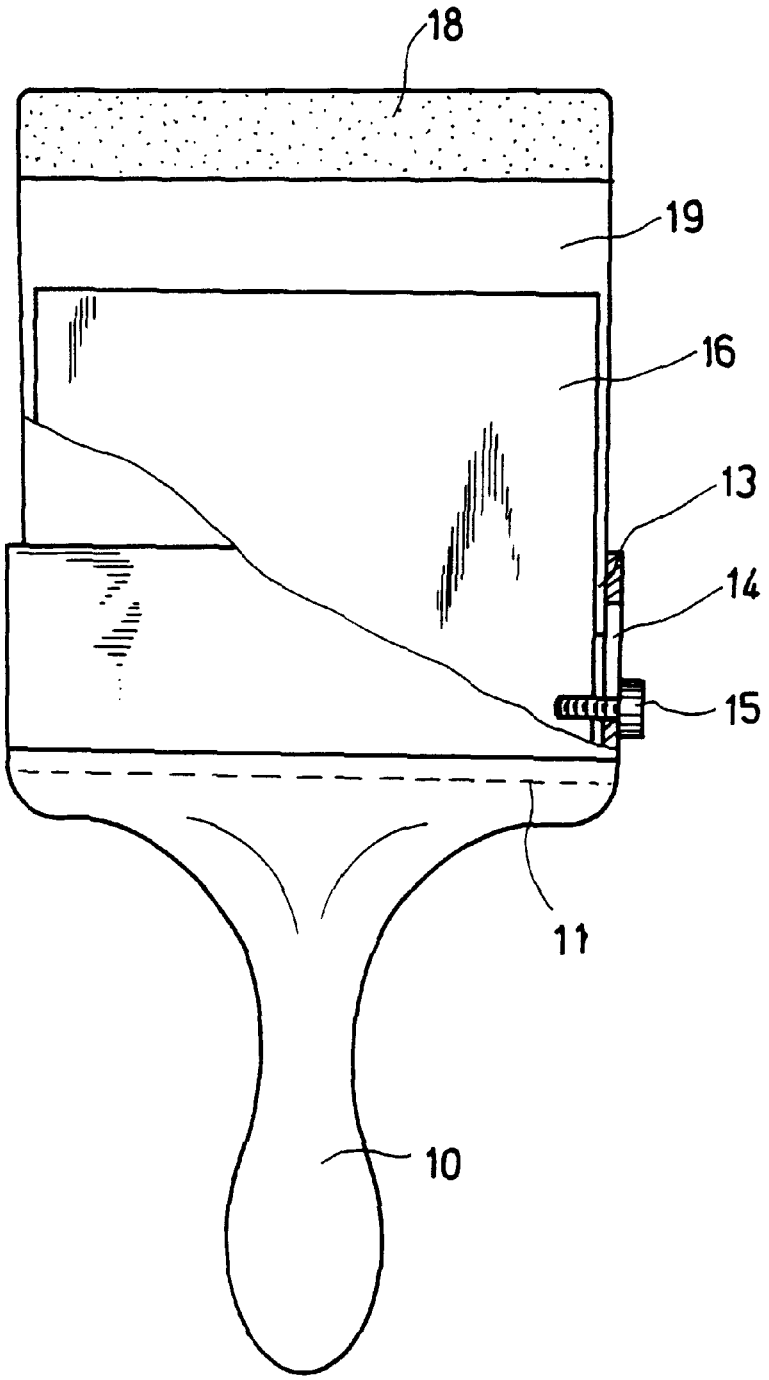
FIG. 3 is a side view of the present invention.

Referring to FIGS. 1 and 2, the present invention Comprises a handle 10, a ferrule 12, and a brushing member 18. Handle 10 is provided with a dovetail slot 11, which engages the end of ferrule 12, allowing various combinations between the handle 10 and a variety of sizes of ferrule 12, as desired. Slot 13 is provided in ferrule 12 to accommodate adjustment blade 16, and an opening 14 is provided on either side of ferrule 12 to allow the insertion of an adjusting knob 15. Adjustment knob 15 projects through opening 14.

Adjustment blade 16 is a sheet member made of a flexible material, for example, plastic or rubber. The bottom edge of the adjustment blade 16 is provided with a threaded bore 17, threaded bore 17 engaging adjustment knob 15 to move blade 16 up or down within ferrule 12. The adjustment blade 16 is sandwiched within brushing member 18, which is made of an absorbent film, bristles, a soft, water absorbent material, or a non-woven fabric. The bottom edge of the adjustment blade is received within accommodation groove 13 of ferrule 12 and a space 19 is formed within brushing member 18 to accommodate movement of adjustment blade 16 within brushing member 18.

In application, brushing member 18 is dipped in the liquid to be applied. When the adjustment blade 16 is set to its lowest position, forming the largest gap between its top edge and the upper edge of the accommodation space 19 of brushing member 18, brushing member 18 is in its most flexible state, yielding a maximum application area. The adjustment blade is moved upward by turning adjustment knob 15 to decrease the gap between the blade's top edge and the upper edge of space 19, thus decreasing the area of application for the brush.

Figure 4:
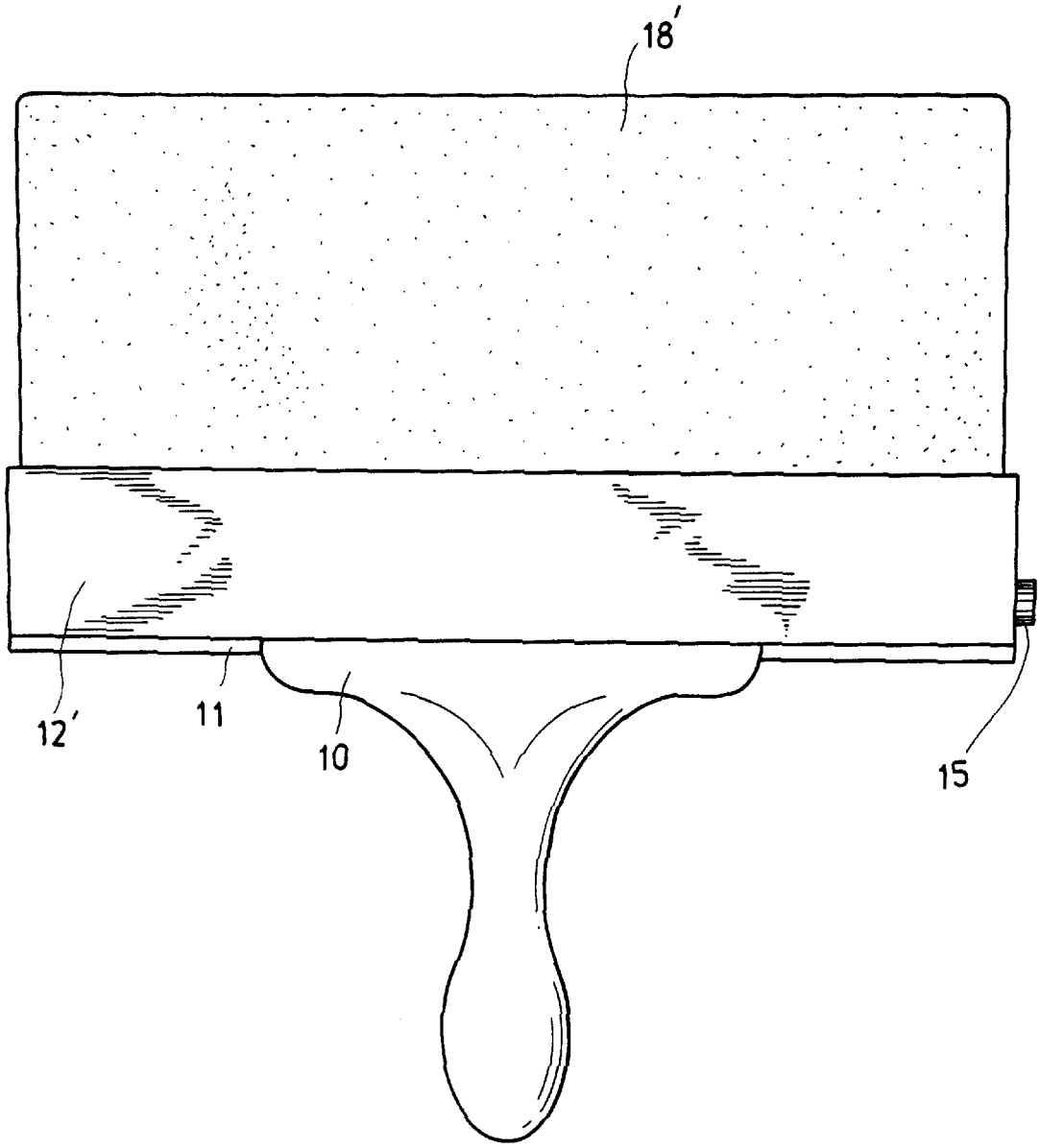
FIG. 4 is a side view of the present invention with a different ferrule attached.

Referring to FIG. 4, the dovetailed engagement of handle 10 with ferrule 12 permits combinations of both the handle and ferrule in different sizes, depending on the job requirements and as desired by the user.

What is claimed is:

1. A brush structure comprising:

a handle member having a female dovetail slot formed in a top edge thereof;

a ferrule member having a male dovetail engagement means for engaging said female dovetail slot, said ferrule member having an adjustment opening formed through one side thereof, said ferrule member having a ferrule recess formed therein;

a bristle member having a bristle recess formed therein, said bristle member being received within said ferrule recess;

an adjustment blade having a threaded bore formed within a lower end thereof, said adjustment blade being received within said bristle recess of said bristle member, said threaded bore being adjacent said adjustment opening; and, a knob for engaging said threaded bore of said adjustment blade, said knob projecting through said adjustment opening allowing for the variable positioning of said adjustment blade within said bristle member.

* * * * *